US005784787A

United States Patent [19]

Jensen

[11] Patent Number: 5,784,787

[45] Date of Patent: Jul. 28, 1998

[54] SHEET METAL PENETRATING TOOL

[76] Inventor: Alan Jensen, 904 Abbot St., Richland, Wash. 99352

[21] Appl. No.: 833,021

[22] Filed: Jan. 3, 1997

[51] Int. Cl.[6] ..... B26F 1/00

[52] U.S. Cl. ..... 30/168; 30/315

[58] Field of Search ..... 30/168, 294, 315, 30/443

[56] References Cited

U.S. PATENT DOCUMENTS

| | | | |
|---|---|---|---|
| 1,624,853 | 4/1927 | Winter | 30/168 |
| 2,199,380 | 5/1940 | Walraven | 30/168 |
| 2,255,196 | 9/1941 | Taylor | 30/168 |
| 4,813,134 | 3/1989 | Buffin | 30/294 |
| 5,315,725 | 5/1994 | Vanden Heuvel | 30/123 |

*Primary Examiner*—Hwei-Siu Payer

*Attorney, Agent, or Firm*—Floyd E. Ivey

[57] ABSTRACT

A tool used to penetrate ductile sheet metal as the initial penetration in preparation for the attachment or installation of ducting and piping and particularly to forming the initial penetration in sheet metal sheet or ducting from which an opening is made for the attachment of lateral, feed, supply or return duct pipe in heating and air conditioning systems and other process or manufacturing systems employing sheet metal in the system construction. The tool has a shaft with a handle, a top edge and a blade edge with a penetrating point extending from the blade edge. An anvil is affixed to the top edge. A sheet metal workpiece is struck by the tool with the penetrating point causing a penetration in the sheet metal surface in preparation of attachment of ducting or other heating, ventilation and air-conditioning or process systems. A duct opening is then completed by the craftsman hammering the tool by striking the anvil and causing the shaft blade edge to cut the sheet metal or by use of tin snips inserted into the opening made by the initial penetration.

10 Claims, 3 Drawing Sheets

SHEET METAL PENETRATING TOOL

FIELD OF THE INVENTION

The present invention relates generally to tools used to penetrate ductile sheet metal as the initial penetration in preparation for the attachment or installation of ducting and piping and particularly to forming the initial penetration in sheet metal sheet or ducting from which an opening is made for the attachment of lateral, feed or return duct pipe in heating and air conditioning systems and other process or manufacturing systems employing sheet metal.

BACKGROUND OF THE INVENTION

Ductile sheet metal is widely used in construction of process systems, processing plants and heating, ventilation and air conditioning systems. Plenums, where pressure is higher within the system then without, and returns, where pressure is lower within the system then without, formed from ducting and piping are frequently constructed for the transmission of fluids in such systems. In most instances where sheet metal is employed, there is the requirement that openings be made in a sheet or duct for the attachment of the apparatuses required for appropriate direction of such fluids. The apparatuses contemplated primarily include sheet metal ducting and fixtures for the attachment of sheet metal ducting to a plenum or return duct or piping system. The process of creating such openings requires the breaching or penetration of a sheet metal sheet or duct to provide an access opening into which is inserted the tip and blades of sheet metal cutters or tin snips. The cutter or tin snip tip and blades are inserted into the penetration and a sheet metal opening is cut to size and shape as required for the apparatus or duct to be attached. The initial breach or penetration is frequently made by driving, with a hammer, the tip of a relatively sharp object, usually a screw driver, into and thereby penetrating the sheet or duct. A hole is cut, by hammering the screw driver, to a size sufficient to accept the tip of tin snips or cutters and the desired opening is cut from the sheet or duct. The common use of screw drivers, as the sharp pointed device for making the initial penetration, is fraught with hazards and annoyances. Hammers, striking the screw driver slip and glance from their intended path striking workers and occasionally causing metal flakes or chips to be propelled creating additional safety hazards. Damage to the screw driver routinely occurs resulting in expense to the sheet metal worker, contractor and ultimately project. The combination of safety hazard, injury and damage to tools so employed poses health and costs concerns to all within the industries employing sheet metal in construction. The present invention is intended to provide multiple functions including in particular the function of creating the referenced and required initial penetration without attendant safety hazards and without the likelihood of tool damage. No patents are disclosed herewith in accordance with 37 CFR 1.97.

SUMMARY OF THE INVENTION

The present invention discloses a hand held tool providing a shaft with a handle and with the shaft bearing a sharp penetrating point and/or blade for forming, frequently with a single stroke, an opening in a sheet metal workpiece. The penetrating point is distal from the handle. A blade is intermediate the penetrating point and the handle. An anvil composes a feature affixed to or incorporated with the shaft which is positioned on the top of the shaft in general opposition to the penetrating point and blade. The anvil will be struck or hammered to cause the penetrating point to pierce the sheet metal where the gauge of sheet metal resists penetration by simply striking the sheet metal surface with the penetrating point of the invention. The principal purposes of the invention are to reduce safety hazards, tool damage and resulting tool replacement expense as encountered in the use of tools such as screw drivers and hammers for the forming of a penetration sufficient to accept the blades of a tin snip.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figures 1, 2, 3, 4:
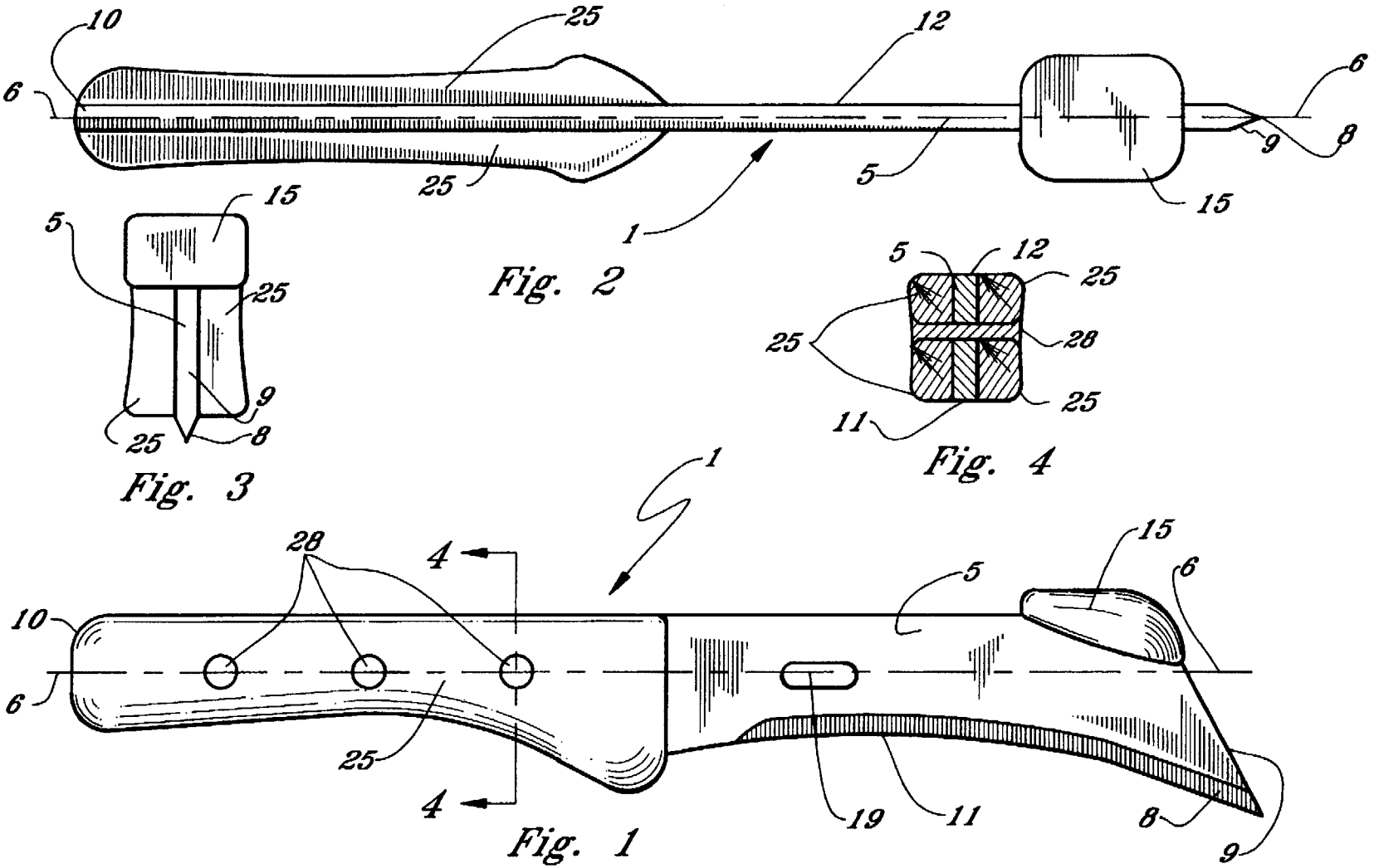
FIG. 1 is a side elevation of the invention showing a sheet metal penetrating tool having a shaft with a handle distal from a penetrating point. An anvil is affixed to the shaft in opposition to the penetrating point. A blade extends from the penetrating point proximal the handle. A slot may be provided in the shaft into which wire, nails or other projections or post like features may be inserted for twisting or other leveraging actions. Shaft first and second ends and blade and top are depicted. A horizontal axis passes generally centrally through the first and second ends and generally bisects the shaft top and blade.
FIG. 2 is a top view of the invention showing the shaft, handle, anvil and penetrating point.
FIG. 3 is a first end elevation view of the invention showing the penetrating point, anvil and handle.
FIG. 4 is a cross section from FIG. 1 showing the interrelationship of handle, rivets and shaft.
Figure 5:
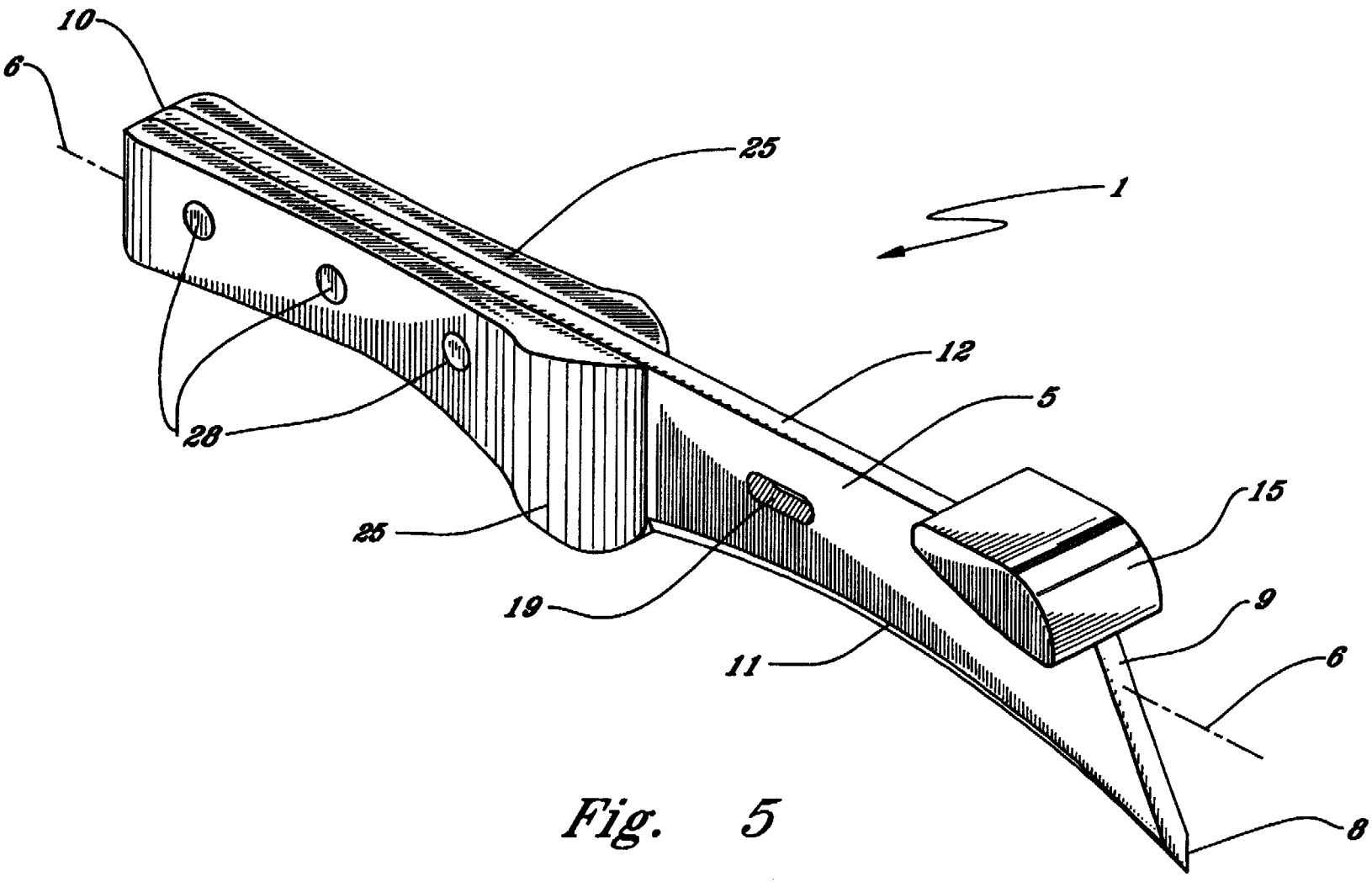
FIG. 5 is a perspective view of the invention.
Figures 6, 7:
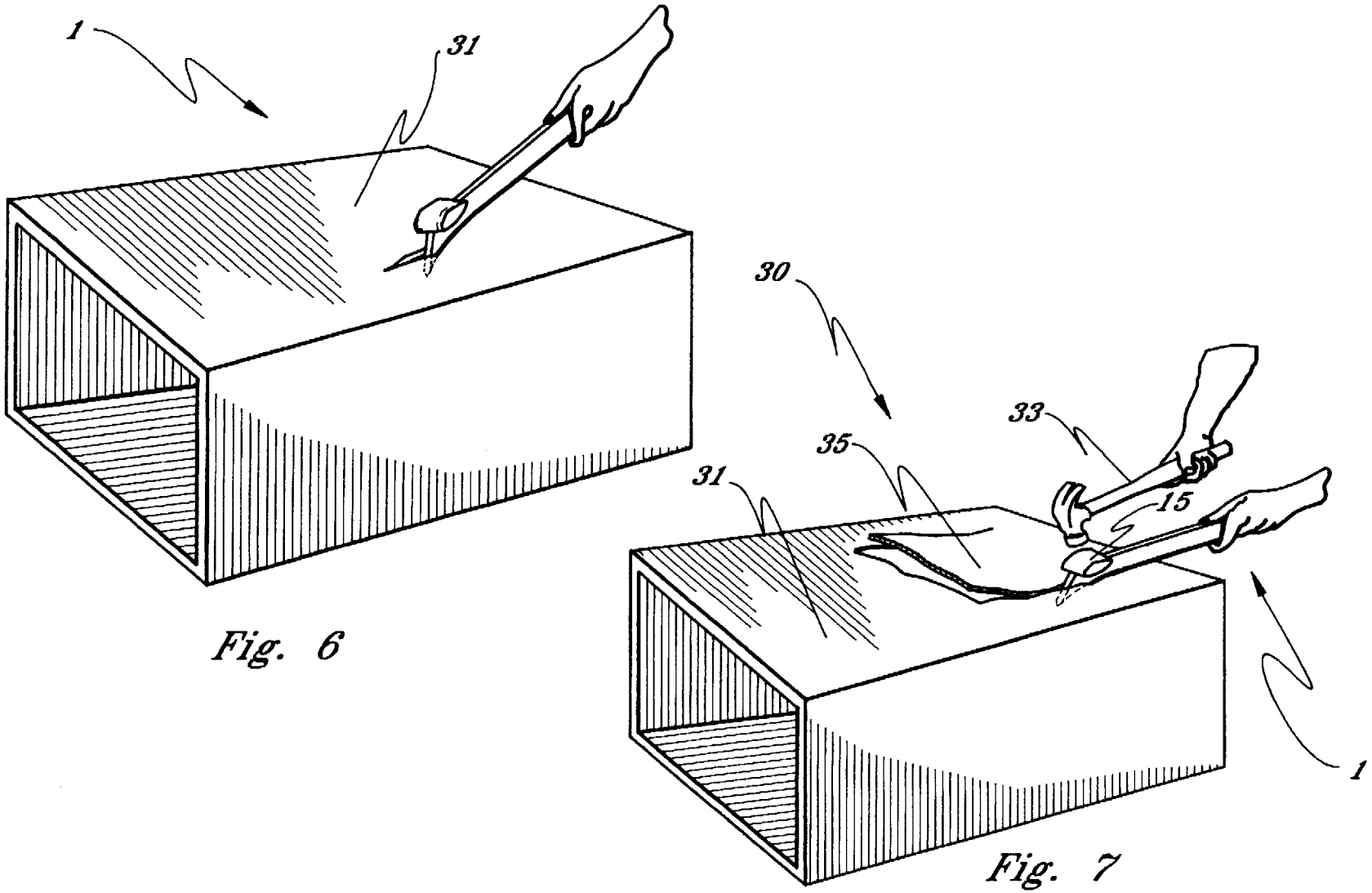
FIG. 6 is a view demonstrating a sheet metal worker penetrating a sheet metal workpiece with the penetrating point of the invention.
FIG. 7 demonstrates the use of the invention where a sheet metal worker strikes the anvil causing the shaft blade edge to cut an opening in a sheet metal workpiece in preparation for attachment of ducting.

The preferred embodiment, shown in FIG. 1 through 5, of the sheet metal penetrating tool 1 has a shaft 5, a first and second end 9, 10, a shaft blade edge 11 generally proximal the first end 9, a shaft top edge 12, a handle means proximal the second end 10 and a longitudinal axis 6 passing through the shaft 5 generally centrally positioned from the first to the second end 9, 10 and generally longitudinally bisecting the shaft 5 between the shaft blade edge and shaft top edge 11,12 as depicted in FIG. 1, 2, 3, 4 and 5. The shaft blade edge 11 is formed generally within the portion of the shaft proximal the first end 9 extending to the handle means. A penetrating point 8 is formed at the shaft blade edge 11 proximal the first end 9 extending away from the shaft top edge 12 as shown in FIG. 1 and 5. The penetrating point 8 provides sheet metal penetrating properties being pointed and sharp sufficiently to penetrate sheet metal of gauges usually employed in heating, ventilation and air conditioning systems and process systems when struck, by a craftsman, against the sheet metal workpiece surface as shown in FIG. 6 and 7. The handle means may be integral with the shaft 5 composed of the same material as the shaft 5 and molded or formed integral with the formation of the shaft or may be composed of separate handle fixtures affixed to the shaft 5. A handle 25 will extend generally distal the shaft blade edge 11 to the second end 10 shown, for example, in FIG. 1, 2 and 5. The handle means may be composed of materials separate from the material composing the shaft 5 including, for example, plastics, wood, metals and other materials. An anvil 15 is integral in construction to the formation of the shaft 5 or is affixed by means to the shaft top edge 12 intermediate the handle 25 and the first end 9 and generally, as shown in FIG. 1, 2 and 5, opposing the penetrating point 8 and proximal the first end 9. The anvil 15 fulfills a dual purpose of providing a hammer function and of being struck with a hammer as a means of causing the penetrating point 8 to penetrate sheet metal and of causing the shaft blade edge 11 to continue the cutting of an opening, within a sheet metal workpiece, for the installation of ducting as shown in FIG. 7. The shaft blade edge 11 provides a surface or edge with sheet metal cutting properties and is sufficiently sharp to cut sheet metal, upon the hammering of the anvil 15, following penetration of the sheet metal surface by the penetrating point 8. The initial penetration of sheet metal by the penetrating point 8 will frequently occur with the craftsman swinging the sheet metal penetrating tool 1 and striking a sheet metal surface with the penetrating point 8. Additional sheet metal cutting will then frequently be accomplished by the craftsman striking the anvil 15 with a hammer. A slot 19, as depicted in FIG. 1 and 5, is formed in the shaft 5 positioned intermediate the shaft blade and shaft top edges 11,12 and additionally intermediate the first end 9 and the handle 25 as shown in FIG. 1, 5 and 6A. The handle 25 is generally affixed to the shaft 5 by means including, for example as in the preferred embodiment, with rivets 28 as shown in FIG. 1, 4 and 5. Means to affix the handle 25 may include adhesive means. The shaft 5 and anvil 15 will generally be formed from mild steel or other metal having structural properties sufficient to withstand the striking and penetration of sheet metal surfaces and hammering of the anvil 15 for penetration and cutting of a sheet metal workpiece with the penetrating point 8 and shaft blade edge 11. The properties of the shaft blade edge 11 will include sheet metal cutting properties. The penetrating point 8 will have sheet metal penetrating properties. The penetrating point 8 and shaft blade edge 11 may be hardened and sharpened. Handle means may be composed of metal, plastic, wood or other equivalents and affixed by a variety of means such as rivets 28, adhesive, friction or the equivalent. The anvil 15 serves the function of providing a surface or portion capable of being hammered to force the penetrating point 8 into a sheet metal workpiece where penetration is not accomplished by striking the workpiece with the penetrating point 8 of the invention. The anvil 15 will be affixed by means, generally welding, to the shaft 5 or may be formed as an integral part of the structure in a metal press or other forming process. The slot 19 may be utilized to twist wire or otherwise in applying leverage forces to a variety of materials encountered in sheet metal work. The slot 19 shape and dimension may vary depending on the particular function expected to be accomplished in the process of forming and working with sheet metal work pieces 30. FIG. 6 and 7 demonstrate the penetration, with the sheet metal penetrating tool 1, of a workpiece surface 31 and use of a hammer 33 striking the anvil 15 to produce a duct opening 35 in a sheet metal workpiece 30; the duct opening 35 would, alternatively be cut or removed by use of tin snips.

An alternative embodiment will have handle means composed of metal which may be formed as a part of the metal press or forming process. An alternative embodiment will have handles 25 formed of plastic affixed by means including rivets, adhesives, molding processes, friction and equivalents to the shaft 5.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A sheet metal penetrating tool comprising:

A. a shaft having a first end and a second end; a shaft top edge extending from the first end to the second end; a shaft blade edge generally proximal the first end, a handle means proximal the second end and a longitudinal axis passing through the shaft generally centrally positioned from the first end to the second end and generally longitudinally bisecting the shaft between the shaft blade edge and the shaft top edge;

B. a penetrating point extends from the shaft blade edge proximal the first end; the penetrating point provides sheet metal penetrating properties; an anvil is affixed by means to the shaft top edge intermediate the first end and the handle means and fulfills a dual purpose of providing a hammer function and of being struck with a hammer as a means of causing the penetrating point to penetrate sheet metal;

C. the shaft blade edge is formed generally within the portion of the shaft proximal the first end extending to the handle means and provides a surface or edge with sheet metal cutting properties.

2. The sheet metal penetrating tool of claim 1 further comprising:

A. the shaft and the anvil composed of mild steel; the handle means composed of a handle integral in construction with the shaft; the anvil formed integral with the construction of the shaft.

3. The sheet metal penetrating tool of claim 1 further comprising:

A. the shaft and the anvil composed of mild steel; the handle means composed of wood affixed to the shaft by means; the anvil formed of mild steel and affixed to the shaft by welding.

4. The sheet metal penetrating tool of claim 3 further comprising:

A. the shaft blade edge and the penetrating point hardened and sharpened; the means affixing the handle means to the shaft comprised of rivets.

5. The sheet metal penetrating tool of claim 1 further comprising:

A. the shaft and the anvil composed of mild steel; the handle means composed of plastic affixed to the shaft by means.

6. The sheet metal penetrating tool of claim 5 further comprising:

A. the shaft blade edge and the penetrating point hardened and sharpened; the means affixing the handle means to the shaft comprised of rivets; the anvil affixed to the shaft by welding.

7. The sheet metal penetrating tool of claim 1 further comprising:

A. the shaft and the anvil composed of metal; the handle means composed integrally with the construction of the shaft; the anvil composed integrally with the construction of the shaft.

8. The sheet metal penetrating tool of claim 1 further comprising:

A. the shaft and the anvil composed of metal; the handle means composed of wood affixed to the shaft by means; the anvil affixed to the shaft by welding.

9. The sheet metal penetrating tool of claim 1 further comprising:

A. the shaft and the anvil composed of metal; the handle means affixed to the shaft by means; the anvil affixed to the shaft by welding.

10. The sheet metal penetrating tool of claim 1 further comprising:

the shaft and the anvil composed of metal; the handle means composed of plastic and affixed to the shaft by means; the anvil affixed to the shaft by welding.

* * * * *